US011055997B1

(12) United States Patent
Bai et al.

(10) Patent No.: US 11,055,997 B1
(45) Date of Patent: Jul. 6, 2021

(54) SYSTEM AND METHOD FOR RESOLVING AMBIGUOUS RIGHT OF WAY

(71) Applicant: Honda Motor Co., Ltd., Tokyo (JP)

(72) Inventors: Xue Bai, Novi, MI (US); Samer Rajab, Novi, MI (US); Danyang Tian, Ann Arbor, MI (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/784,756

(22) Filed: Feb. 7, 2020

(51) Int. Cl.
*G08G 1/01* (2006.01)
*G08G 1/0967* (2006.01)
*G08G 1/056* (2006.01)

(52) U.S. Cl.
CPC ..... *G08G 1/096791* (2013.01); *G08G 1/0112* (2013.01); *G08G 1/0133* (2013.01); *G08G 1/0145* (2013.01); *G08G 1/056* (2013.01)

(58) Field of Classification Search
CPC ..... G08G 1/096791; G08G 1/0112; G08G 1/0133; G08G 1/0145; G01G 1/056
USPC ..... 340/907
See application file for complete search history.

(56) References Cited

U.S. PATENT DOCUMENTS 3,688,254 A * 8/1972 Uryu ..... G08G 1/08 340/923
6,617,981 B2 * 9/2003 Basinger ..... G08G 1/081 340/907
6,940,422 B1 * 9/2005 Bachelder ..... G08G 1/087 340/906
7,898,432 B2 3/2011 McNew et al.
9,218,739 B2 12/2015 Trombley et al.
9,536,427 B2 1/2017 Tonguz et al.
9,818,299 B1 11/2017 Jammoussi et al.
9,865,162 B2 1/2018 Kurotobi et al.
10,217,357 B1 * 2/2019 Elsheemy ..... G08G 1/09623
10,304,333 B2 5/2019 Engel et al.
2002/0126022 A1 * 9/2002 Ellis ..... G01S 13/931 340/901
2009/0109061 A1 * 4/2009 McNew ..... G08G 1/164 340/928

(Continued)

FOREIGN PATENT DOCUMENTS

CN 107274699 10/2017
GB 2510698 8/2014

(Continued)

*Primary Examiner* — Ojiako K Nwugo
(74) *Attorney, Agent, or Firm* — Rankin, Hill & Clark LLP

(57) ABSTRACT

According to one aspect, a computer-implemented method for communication between a plurality of vehicles at an intersection includes detecting the intersection ahead of a first vehicle. The method includes determining a time of arrival of a first vehicle at the intersection and a time of arrival of a second vehicle at the intersection is approximately the same. Further, the method includes receiving behavior data about the first vehicle for a previous time of duration before the time of arrival of the first vehicle at the intersection, and receiving behavior data about the second vehicle for a previous time of duration before the time of arrival of the second vehicle at the intersection. The method includes transmitting a resolution message including information for determining a right of way maneuver between the first vehicle and the second vehicle at the intersection.

19 Claims, 6 Drawing Sheets

(56) References Cited

U.S. PATENT DOCUMENTS

| | | | | |
|---|---|---|---|---|
| 2013/0285840 | A1* | 10/2013 | Allen | G08G 1/07 340/923 |
| 2017/0249836 | A1* | 8/2017 | Laur | G08G 1/0137 |
| 2019/0236955 | A1* | 8/2019 | Hu | G05D 1/0022 |
| 2020/0001779 | A1* | 1/2020 | Alexander | G05D 1/0088 |
| 2020/0168096 | A1* | 5/2020 | Eckstein | B60W 30/0956 |

FOREIGN PATENT DOCUMENTS

| | | |
|---|---|---|
| KR | 20130120694 | 11/2013 |
| WO | WO2017174601 | 10/2017 |

* cited by examiner

SYSTEM AND METHOD FOR RESOLVING AMBIGUOUS RIGHT OF WAY

BACKGROUND

In most jurisdictions, a four-way intersection is a traffic management system that requires vehicles on all approaches to the intersection to stop at the intersection before proceeding through the intersection. Typically, if a vehicle arrives at the intersection at the same time as another vehicle, the vehicle on the right has the right of way. However, in some situations, it can be difficult to determine which vehicle arrives at the intersection first and/or which vehicle has the right of way. It can also be difficult to communicate signals at the intersection to indicate which vehicle has the right-of-way. This ambiguity at the intersection can create delay, confusion, increased wear on vehicle brakes, and possibly collisions at the intersection. Reliable communication between the vehicles can be helpful for resolving ambiguity.

BRIEF DESCRIPTION

According to one aspect, a computer-implemented method for communication between a plurality of vehicles at an intersection includes detecting the intersection ahead of a first vehicle. The first vehicle is travelling along a first road segment that leads to the intersection and a second vehicle is travelling along a second road segment that leads to the intersection. The method includes determining a time of arrival of the first vehicle at the intersection and a time of arrival of the second vehicle at the intersection is approximately the same. Further, the method includes receiving behavior data about the first vehicle travelling along the first road segment for a previous time of duration before the time of arrival of the first vehicle at the intersection, and receiving behavior data about the second vehicle travelling along the first road segment for a previous time of duration before the time of arrival of the second vehicle at the intersection. The method includes transmitting a resolution message to the first vehicle or the second vehicle based on comparing the behavior data about the first vehicle and the behavior data about the second vehicle. The resolution message includes information for determining a right of way maneuver between the first vehicle and the second vehicle at the intersection.

According to another aspect, a system for communication between a plurality of vehicles at an intersection includes a sensor system for detecting the first vehicle and the second vehicle approaching the intersection. The first vehicle is travelling along a first road segment that leads to the intersection and the second vehicle is travelling along a second road segment that leads to the intersection. The system also includes a processor operatively connected for computer communication with the sensor system using a network. The processor determines a time of arrival of the first vehicle at the intersection and a time of arrival of the second vehicle at the intersection is approximately the same. The processor receives behavior data from the sensor system about the first vehicle travelling along the first road segment for a previous time of duration before the time of arrival of the first vehicle at the intersection. The processor receives behavior data from the sensor system about the second vehicle travelling along the second road segment for a previous time of duration before the time of arrival of the second vehicle at the intersection. The processor transmits a resolution message to the first vehicle or the second vehicle based on comparing the behavior data about the first vehicle and the behavior data about the second vehicle. The resolution message includes information for determining a right of way maneuver between the first vehicle and the second vehicle at the intersection.

According to a further aspect, a non-transitory computer-readable storage medium including instructions that when executed by a processor, cause the processor to detect a first vehicle and a second vehicle travelling towards an intersection and determine a time of arrival of the first vehicle at the intersection and a time of arrival of the second vehicle at the intersection is approximately the same. The instructions cause the processor to receive behavior data about the first vehicle for a previous time of duration before the time of arrival of the first vehicle at the intersection, and receive behavior data about the second vehicle for a previous time of duration before the time of arrival of the second vehicle at the intersection. The instructions cause the processor to generate a resolution message including instructions for determining a right of way maneuver between the first vehicle and the second vehicle at the intersection.

BRIEF DESCRIPTION OF THE DRAWINGS

The accompanying drawings, which are incorporated in and constitute a part of the specification, illustrate various systems, methods, devices, and other embodiments of the disclosure. It will be appreciated that the illustrated element boundaries (e.g., boxes, groups of boxes, directional lines, or other shapes) in the figures represent one embodiment of the boundaries. In some embodiments one element may be designed as multiple elements or that multiple elements may be designed as one element. In some embodiments, an element shown as an internal component of another element may be implemented as an external component and vice versa. Furthermore, elements may not be drawn to scale.

DETAILED DESCRIPTION

Figure 1:
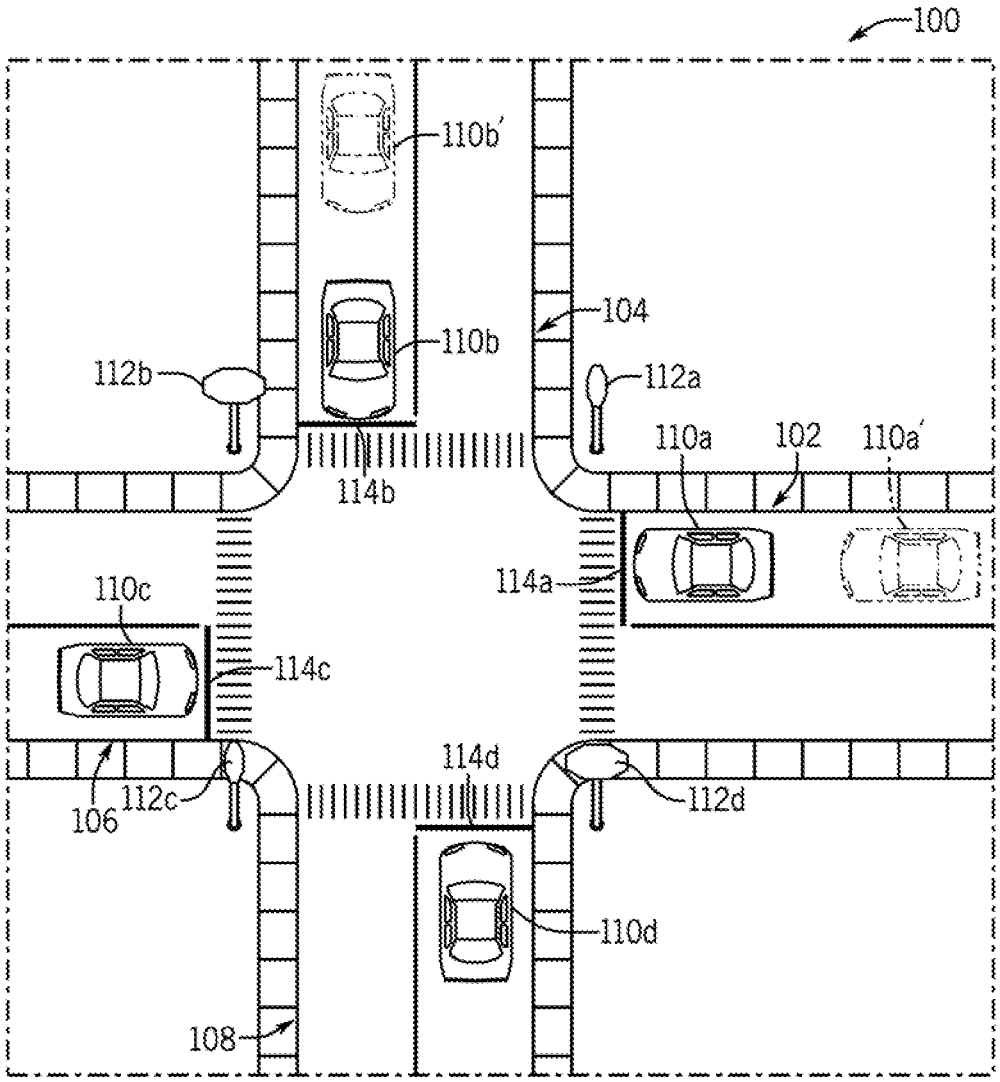
FIG. 1 is a schematic view of an intersection according to an exemplary embodiment.

The following includes definitions of selected terms employed herein. The definitions include various examples and/or forms of components that fall within the scope of a term and that may be used for implementation. The examples are not intended to be limiting. Further, the components discussed herein, may be combined, omitted or organized with other components or into different architectures.

"Bus," as used herein, refers to an interconnected architecture that is operably connected to other computer components inside a computer or between computers. The bus may transfer data between the computer components. The bus may be a memory bus, a memory processor, a peripheral bus, an external bus, a crossbar switch, and/or a local bus, among others. The bus may also be a vehicle bus that interconnects components inside a vehicle using protocols such as Media Oriented Systems Transport (MOST), Processor Area network (MAY), Local Interconnect network (LIN), among others.

"Component." as used herein, refers to a computer-related entity (e.g., hardware, firmware, instructions in execution, combinations thereof). Computer components may include, for example, a process running on a processor, a processor, an object, an executable, a thread of execution, and a computer. A computer component(s) may reside within a process and/or thread. A computer component may be localized on one computer and/or may be distributed between multiple computers.

"Computer communication," as used herein, refers to a communication between two or more computing devices (e.g., computer, personal digital assistant, cellular telephone, network device, vehicle, vehicle computing device, infrastructure device, roadside device) and may be, for example, a network transfer, a data transfer, a file transfer, an applet transfer, an email, a hypertext transfer protocol (HTTP) transfer, and so on. A computer communication may occur across any type of wired or wireless system and/or network having any type of configuration, for example, a local area network (LAN), a personal area network (PAN), a wireless personal area network (WPAN), a wireless network (WAN), a wide area network (WAN), a metropolitan area network (MAN), a virtual private network (VPN), a cellular network, a token ring network, a point-to-point network, an ad hoc network, a mobile ad hoc network, a vehicular ad hoc network (VANET), a vehicle-to-vehicle (V2V) network, a vehicle-to-everything (V2X) network, a vehicle-to-infrastructure (V2I) network, among others. Computer communication may utilize any type of wired, wireless, or network communication protocol including, but not limited to, Ethernet (e.g., IEEE 802.3), WiFi (e.g., IEEE 802.11), communications access for land mobiles (CALM), WiMax, Bluetooth, Zigbee, ultra-wideband (UWAB), multiple-input and multiple-output (MIMO), telecommunications and/or cellular network communication (e.g., SMS, MMS, 3G, 4G, LTE, 5G, GSM, CDMA, WAVE), satellite, dedicated short range communication (DSRC), among others.

"Computer-readable medium," as used herein, refers to a non-transitory medium that stores instructions and/or data. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, an ASIC, a CD, other optical medium, a RAM, a ROM, a memory chip or card, a memory stick, and other media from which a computer, a processor or other electronic device may read.

"Database," as used herein, is used to refer to a table. In other examples, "database" may be used to refer to a set of tables. In still other examples, "database" may refer to a set of data stores and methods for accessing and/or manipulating those data stores. A database may be stored, for example, at a disk and/or a memory.

"Disk," as used herein may be, for example, a magnetic disk drive, a solid-state disk drive, a floppy disk drive, a tape drive, a Zip drive, a flash memory card, and/or a memory stick. Furthermore, the disk may be a CD-ROM (compact disk ROM), a CD recordable drive (CD-R drive), a CD rewritable drive (CD-RW drive), and/or a digital video ROM drive (DVD ROM). The disk may store an operating system that controls or allocates resources of a computing device.

"Input/output device" (I/O device) as used herein can include devices for receiving input and/or devices for outputting data. Specifically, the term "input device" includes, but it not limited to: keyboard, microphones, pointing and selection devices, cameras, imaging devices, video cards, displays, push buttons, rotary knobs, and the like. The term "input device" additionally includes graphical input controls that take place within a user interface which can be displayed by various types of mechanisms such as software and hardware based controls, interfaces, touch screens, touch pads or plug and play devices. An "output device" includes, but is not limited to: display devices, and other devices for outputting information and functions.

"Logic circuitry," as used herein, includes, but is not limited to, hardware, firmware, a non-transitory computer readable medium that stores instructions, instructions in execution on a machine, and/or to cause (e.g., execute) an action(s) from another logic circuitry, module, method and/or system. Logic circuitry may include and/or be a part of a processor controlled by an algorithm, a discrete logic (e.g., ASIC), an analog circuit, a digital circuit, a programmed logic device, a memory device containing instructions, and so on. Logic may include one or more gates, combinations of gates, or other circuit components. Where multiple logics are described, it may be possible to incorporate the multiple logics into one physical logic. Similarly, where a single logic is described, it may be possible to distribute that single logic between multiple physical logics.

"Memory," as used herein may include volatile memory and/or nonvolatile memory. Non-volatile memory may include, for example, ROM (read only memory), PROM (programmable read only memory), EPROM (erasable PROM), and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDRSDRAM), and direct RAM bus RAM (DRRAM). The memory may store an operating system that controls or allocates resources of a computing device.

"Operable connection," or a connection by which entities are "operably connected," is one in which signals, physical communications, and/or logical communications may be sent and/or received. An operable connection may include a wireless interface, a physical interface, a data interface, and/or an electrical interface.

"Module," as used herein, includes, but is not limited to, non-transitory computer readable medium that stores instructions, instructions in execution on a machine, hardware, firmware, software in execution on a machine, and/or combinations of each to perform a function(s) or an action (s), and/or to cause a function or action from another module, method, and/or system. A module may also include logic, a software controlled microprocessor, a discrete logic circuit, an analog circuit, a digital circuit, a programmed logic device, a memory device containing executing instructions, logic gates, a combination of gates, and/or other circuit components. Multiple modules may be combined into one module and single modules may be distributed among multiple modules.

"Portable device," as used herein, is a computing device typically having a display screen with user input (e.g., touch, keyboard) and a processor for computing. Portable devices include, but are not limited to, handheld devices, mobile devices, smart phones, laptops, tablets and e-readers.

"Processor," as used herein, processes signals and performs general computing and arithmetic functions. Signals processed by the processor may include digital signals, data signals, computer instructions, processor instructions, messages, a bit, a bit stream, that may be received, transmitted and/or detected. Generally, the processor may be a variety of various processors including multiple single and multicore processors and co-processors and other multiple single and multicore processor and co-processor architectures. The processor may include logic circuitry to execute actions and/or algorithms.

"Vehicle," as used herein, refers to any moving vehicle that is capable of carrying one or more human occupants and is powered by any form of energy. The term "vehicle" includes, but is not limited to cars, trucks, vans, minivans, SUVs, motorcycles, scooters, boats, go-karts, amusement ride cars, rail transport, personal watercraft, and aircraft. In some cases, a motor vehicle includes one or more engines. Further, the term "vehicle" may refer to an electric vehicle (EV) that is capable of carrying one or more human occupants and is powered entirely or partially by one or more electric motors powered by an electric battery. The EV may include battery electric vehicles (BEV) and plug-in hybrid electric vehicles (PHEV). The term "vehicle" may also refer to an autonomous vehicle and/or self-driving vehicle powered by any form of energy. The autonomous vehicle may carry one or more human occupants. Further, the term "vehicle" may include vehicles that are automated or non-automated with pre-determined paths or free-moving vehicles.

"Vehicle control system," and/or "vehicle system," as used herein may include, but is not limited to, any automatic or manual systems that may be used to enhance the vehicle, driving, and/or security. Exemplary vehicle systems include, but are not limited to: an electronic stability control system, an anti-lock brake system, a brake assist system, an automatic brake prefill system, a low speed follow system, a cruise control system, a collision warning system, a collision mitigation braking system, an auto cruise control system, a lane departure warning system, a blind spot indicator system, a lane keep assist system, a navigation system, a transmission system, brake pedal systems, an electronic power steering system, visual devices (e.g., camera systems, proximity sensor systems), a climate control system, an electronic pretensioning system, a monitoring system, a passenger detection system, a vehicle suspension system, a vehicle seat configuration system, a vehicle cabin lighting system, an audio system, a sensory system, an interior or exterior camera system among others.

The systems and methods discussed herein facilitate control and communication between vehicles and infrastructures to resolve traffic situations. For example, allowing a host vehicle to communicate with other vehicles at an intersection to decide which vehicles have the right of way to cross the intersection. Referring now to the drawings, wherein the showings are for purposes of illustrating one or more exemplary embodiments and not for purposes of limiting same, FIG. 1 is an illustrative example of a traffic scenario, specifically, an intersection 100. The intersection 100 includes four road segments (e.g., roads) that meet at the intersection 100. Specifically, a first road 102, a second road 104, a third road 106, and a fourth road 108. Thus, the intersection 100 in FIG. 1 is a four way intersection. It is understood that any number of roads, lanes, and intersections other than that shown in FIG. 1 can be implemented with the methods and system discussed herein.

In FIG. 1, the intersection 100 is a four way stop sign intersection (i.e., a controlled intersection). A controlled intersection, as used herein, is an intersection in which an entrance into the intersection from any of the approaches (e.g., roads, lanes) is controlled by a regulatory sign or traffic signal (e.g., traffic light, yield sign, stop sign, or other traffic indicators). Thus, in FIG. 1, a first stop sign 112*a* controls traffic at the intersection 100 from the first road 102, a second stop sign 112*b* controls traffic at the intersection 100 from the second road 104, a third stop sign 112*c* controls traffic at the intersection 100 from the third road 106, and a fourth stop sign 112*d* controls traffic at the intersection 100 from the fourth road 108. Although stop signs are used in the examples discussed herein, it is understood that any type of traffic indicator (e.g., lights, other types of regulatory signs and/or traffic signals) may be implemented.

Additionally, a stop line is located in proximity to each stop sign where the vehicle must stop before the stop line. For example, in FIG. 1, a first stop line 114*a* controls traffic at the intersection 100 from the first road 102, a second stop line 114*b* controls traffic at the intersection 100 from the second road 104, a third stop line 114*c* controls traffic at the intersection 100 from the third road 106, and a fourth stop line 114*d* controls traffic at the intersection 100 from the fourth road 108. It is understood that in some embodiments not shown in FIG. 1, a stop line may not be present with each stop sign.

In FIG. 1, four vehicles are shown stopped at the intersection 100, namely, a first vehicle 110*a*, a second vehicle 110*b*, a third vehicle 110*c*, and a fourth vehicle 110*d*. In some embodiments discussed herein, the first vehicle 110*a*, the second vehicle 110*b*, the third vehicle 110*c*, and the fourth vehicle 110*d* are collectively referred to as the vehicles 110 or a plurality of vehicles 110. In most jurisdictions, at a four-way stop, if two vehicles reach an intersection simultaneously, the vehicle on the left must yield the right of way to the vehicle on the right. However, in some situations, it may be difficult to determine which vehicle arrived at the intersection first and/or which vehicle has the right of way. As an illustrative example, the first vehicle 110*a* arrives at the intersection 100 slightly earlier (e.g., 0.5 seconds) than the second vehicle 110*b*, but at approximately the same time. This leads to ambiguity for the drivers of both the first vehicle 110*a* and the second vehicle 110*b* as to which vehicle has the right of way at the intersection 100. Accordingly, as discussed herein, communication between the vehicles can be implemented to assist determination and execution of rights of way at the intersection 100.

Figure 2:
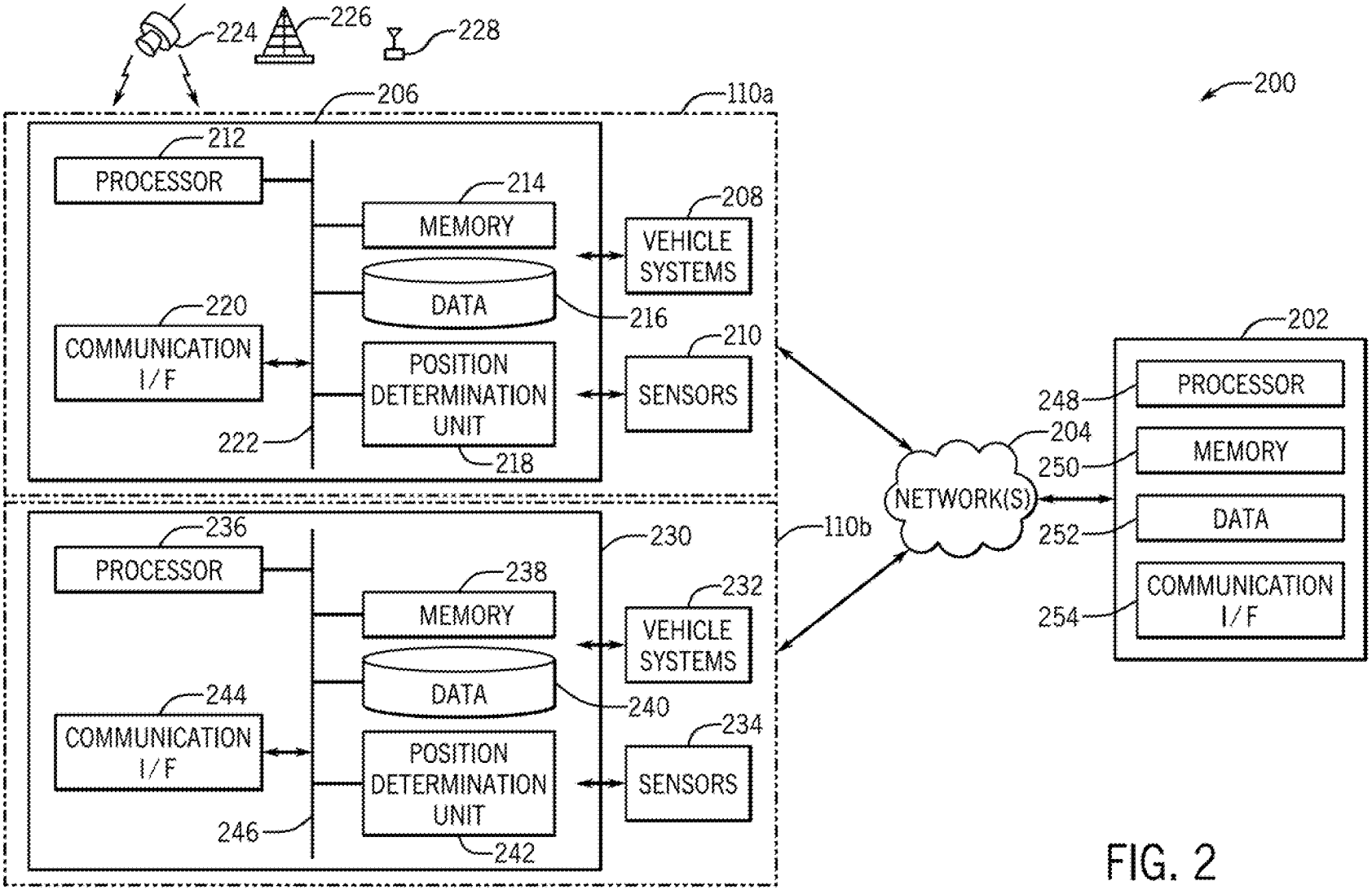
FIG. 2 is a block diagram of a system for resolving ambiguous right of way according to an exemplary embodiment.

Referring now to FIG. 2, a block diagram of a system 200 for resolving ambiguous right of way according to an exemplary embodiment is shown. The system 200 can be implemented with the components shown in FIG. 1. For convenience, like names and numerals represent like elements. In FIG. 2, the system 200 includes the first vehicle 110*a*, the second vehicle 110*b*, and a remote server 202 each operatively connected for computer communication using, for example, the network 204. For simplicity, the third vehicle 110*c* and the fourth vehicle 110*d* are not show in FIG. 2. However, it is understood that the third vehicle 110*c* and the fourth vehicle 110*d* can include one or more of the components and/or functions discussed herein with respect to the first vehicle 110*a* and/or the second vehicle 110*b*. Further, it is understood that the components of the first vehicle 110*a*, the second vehicle 110*b*, and the remote server 202 as well as the components of other systems, hardware architectures, and software architectures discussed herein, can be combined, omitted, or organized into different architectures for various embodiments.

The first vehicle 110*a* includes a vehicle computing device (VCD) 206, vehicle systems 208, and sensors 210. Generally, the VCD 206 includes a processor 212, a memory 214, a data store 216, a position determination unit 218, and a communication interface (I/F) 220, which are each operably connected for computer communication via a bus 222 and/or other wired and wireless technologies discussed herein. The VCD 206, can include provisions for processing, communicating and interacting with various components of the first vehicle 110*a* and other components of the system 200, including the second vehicle 110*b*, the third vehicle 110*c*, the fourth vehicle 110*d*, and the remote server 202.

The processor 212 can include logic circuitry with hardware, firmware, and software architecture frameworks for facilitating control of the first vehicle 110*a* and facilitating communication between the first vehicle 110*a*, the second vehicle 110*b*, the third vehicle 110*c*, the fourth vehicle 110*d*, and the remote server 202. Thus, in some embodiments, the processor 212 can store application frameworks, kernels, libraries, drivers, application program interfaces, among others, to execute and control hardware and functions discussed herein. In some embodiments, the memory 214 and/or the data store (e.g., disk) 216 can store similar components as the processor 212 for execution by the processor 212.

The position determination unit 218 can include hardware (e.g., sensors) and software to determine and/or acquire position data about the first vehicle 110*a*. For example, the position determination unit 218 can include a global positioning system (GPS) unit (not shown) and/or an inertial measurement unit (IMU) (not shown). Thus, the position determination unit 218 can provide a geoposition of the first vehicle 110*a* based on satellite data from, for example, a global position source unit 224, or from any Global Navigational Satellite infrastructure (GNSS), including GPS, Glonass (Russian) and/or Galileo (European). Further, the position determination unit 218 can provide dead-reckoning data or motion data from, for example, a gyroscope, accelerometer, magnetometers, among other sensors (not shown). In some embodiments, the position determination unit 218 can be a navigation system that provides navigation maps, map data, and navigation information to the first vehicle 110*a*.

The communication interface (I/F) 220 can include software and hardware to facilitate data input and output between the components of the VCD 206 and other components of the system 200. Specifically, the communication I/F 220 can include network interface controllers (not shown) and other hardware and software that manages and/or monitors connections and controls bi-directional data transfer between the communication I/F 220 and other components of the system 200 using, for example, the network 204. In particular, the communication I/F 220 can facilitate communication (e.g., exchange data and/or transmit messages) with other vehicles and/or devices, using any type of communication hardware and/or protocols discussed herein. For example, the computer communication can be implemented using a wireless network antenna 226 (e.g., cellular, mobile, satellite, or other wireless technologies) or road side equipment (RSE) 228 (e.g., Dedicated Short Range Communications or other wireless technologies), and/or the network 204. Further, the communication I/F 220 can also include input/output devices of the first vehicle 110*a*. For example, any devices (not shown) for receiving input and/or devices for outputting data. In some embodiments described herein, communication between vehicles can be facilitated by displaying and/or receiving communication on a display in the first vehicle 110*a*.

Referring again to the first vehicle 110*a*, the vehicle systems 208 can include any type of vehicle control system and/or system described herein to enhance the first vehicle 110*a* and/or driving of the first vehicle 110*a*. For example, the vehicle systems 208 can include autonomous driving systems, driver-assist systems, adaptive cruise control systems, lane departure warning systems, merge assist systems, freeway merging, exiting, and lane-change systems, collision warning systems, integrated vehicle-based safety systems, and automatic guided vehicle systems, or any other advanced driving assistance systems (ADAS).

The sensors 210, which can be implemented with the vehicle systems 208, can include various types of sensors for use with the first vehicle 110*a* and/or the vehicle systems 208 for detecting and/or sensing a parameter of first vehicle 110*a*, the vehicle systems 208, and/or the environment surrounding the first vehicle 110*a*. For example, the sensors 210 can provide data about vehicles in proximity to the first vehicle 110*a* and/or the intersection 100. In some embodiments, the sensors 210 acquire data about the first vehicle 110*a* as the first vehicle 110*a* approaches the intersection 100 and as the first vehicle 110*a* stops at the intersection 100. The sensors 210 can also acquire data about the intersection 100, for example, data about the other vehicles approaching and/or stopped at the intersection 100.

The sensors 210 may include, but are not limited to: acceleration sensors, speed sensors, braking sensors, proximity sensors, vision sensors, ranging sensors, seat sensors, seat-belt sensors, door sensors, environmental sensors, yaw rate sensors, steering sensors, GPS sensors, among others. It is also understood that the sensors 210 may be any type of sensor, for example, acoustic, electric, environmental, optical, imaging, light, pressure, force, thermal, temperature, proximity, among others. Further, the sensors 210 can be disposed in one or more portions of the first vehicle 110*a*, worn by a driver (not shown), integrated into a portable device (not shown), carried by the driver (not shown), integrated into an article of clothing (not shown) worn by the driver, or integrated into the body of the driver (e.g. an implant) (not shown).

Referring again to the system 200, the second vehicle 110*b* includes a vehicle computing device (VCD) 230, vehicle systems 232, and sensors 234. Generally, the VCD 230 includes a processor 236, a memory 238, a data store 240, a position determination unit 242, and a communication interface (I/F) 244, which are each operably connected for computer communication via a bus 246 and/or other wired and wireless technologies discussed herein. For simplicity, the components of the second vehicle 110*b* are not discussed in detail, however, it is understood that the components of the second vehicle 110*b* can include the same and/or similar functionality as discussed above with the first vehicle 110*a*.

Referring again to the system 200, the remote server 202 includes a processor 248, a memory 250, a data store 252, and a communication interface (I/F) 254. The processor 248 can include logic circuitry with hardware, firmware, and software architecture frameworks for facilitating control and/or communication between the first vehicle 110*a*, the second vehicle 110*b*, the third vehicle 110*c*, the fourth vehicle 110*d*, and the remote server 202. Thus, in some embodiments, the processor 248 can store application frameworks, kernels, libraries, drivers, application program interfaces, among others, to execute and control hardware and functions discussed herein. In some embodiments, the memory 250 and/or the data store (e.g., disk) 252 can store similar components as the processor 248 for execution by the processor 248.

The communication interface (I/F) 254 can include software and hardware to facilitate data input and output between the components of the remote server 202 and other components of the system 200. The communication I/F 254 can include network interface controllers (not shown) and other hardware and software that manages and/or monitors connections and controls bi-directional data transfer between the communication I/F 254 and other components of the system 200 using, for example, the network 204. In particular, the communication I/F 254 can facilitate communication (e.g., exchange data and/or transmit messages) with other vehicles and/or devices, using any type of communication hardware and/or protocols discussed herein. For example, the computer communication can be implemented using a wireless network antenna 226 (e.g., cellular, mobile, satellite, or other wireless technologies) or RSE 228 (e.g., Dedicated Short Range Communications or other wireless technologies), and/or the network 204.

Using the system and network configuration discussed above, traffic situations at the intersection 100 can be monitored and resolved. In particular, communication between one or more entities in the system 200 can be used to resolve ambiguous right of way situations and control maneuvers of one or more vehicles through the intersection 100. Detailed embodiments describing exemplary methods using the system and network configuration discussed above will now be discussed in detail.

Figure 3:
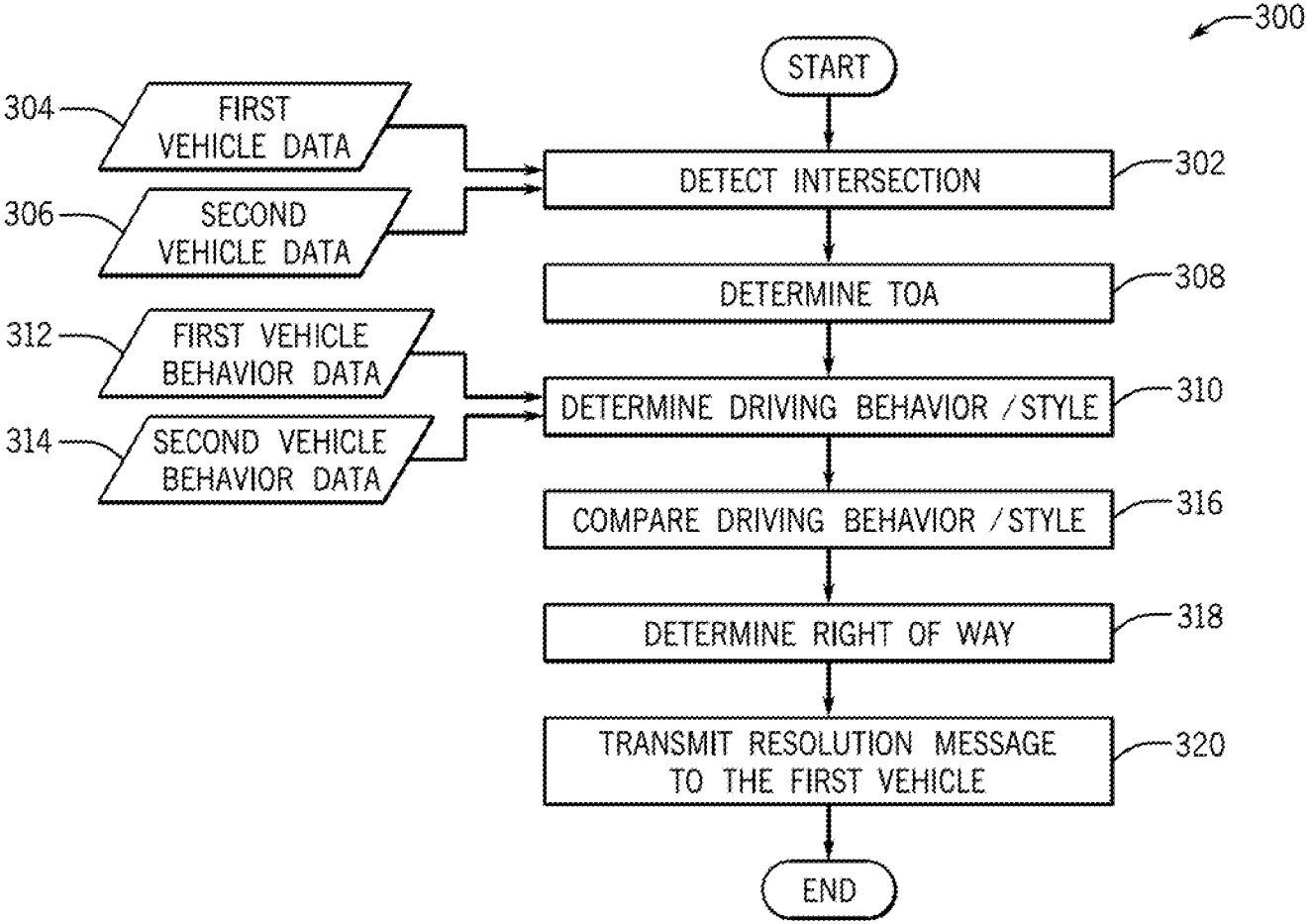
FIG. 3 is a process flow diagram of a method for resolving ambiguous right of way according to an exemplary embodiment.

With reference to FIG. 3, an exemplary method 300 describes operations of one or more components of FIGS. 1 and 2 for resolving ambiguous right of way scenarios. Although FIG. 3 is described with respect to the first vehicle 110*a* and the second vehicle 110*b*, it is understood that the methods and systems can be applied to any number of vehicles including the third vehicle 110*c* and the fourth vehicle 110*d*. At block 302, the method 300 includes detecting the intersection 100 ahead of the first vehicle 110*a*. As shown in FIG. 1, the first vehicle 110*a* is travelling along a first road segment (e.g., the first road 102) that leads to the intersection 100 and the second vehicle 110*b* is travelling along a second road segment (e.g., the second road 104) that leads to the intersection 100.

In one embodiment, the processor 212 receives first vehicle data 304 from, for example, the sensors 210 to determine and/or identify the intersection 100 ahead of the first vehicle 110*a*. In some embodiments, second vehicle data 306 from, for example, sensors 234 can also be used to determine and/or identify the intersection 100. In another embodiment, data from the remote server 202 can be used to determine and/or identify the intersection 100. For example, the remote server 202 can acquire and/or store data from the RSE 228 in proximity to the intersection 100. The remote server 202 can also acquire data from one or more of the first vehicle 110*a*, the second vehicle 110*b*, the third vehicle 110*c*, and the fourth vehicle 110*d*. Furthermore, the position determination unit 218 can acquire map data or other geoposition data from the global position source unit 224 to determine and/or identify the intersection 100. Thus, the remote server 202 can collect position and movement data about a plurality of vehicles approaching the intersection 100.

Referring again to the method 300, at block 308, the method 300 includes determining a time of arrival (TOA) of the first vehicle 110*a* at the intersection 100 and a time of arrival (TOA) of the second vehicle 110*b* at the intersection 100. As discussed herein, the TOA is a point in time when a vehicle comes to a complete stop (e.g., vehicle is not in motion) at the intersection 100. Accordingly, the TOA of the first vehicle 110*a* is a point in time when the first vehicle 110*a* comes to a complete stop at the intersection 100 (e.g., a complete stop at the first stop sign 112*a* and/or the first stop line 114*a*). Similarly, the TOA of the second vehicle 110*b* is a point in time when the second vehicle 110*b* comes to a complete stop at the intersection 100 (e.g., a complete stop at the first stop sign 112*a* and/or the first stop line 114*a*). The TOA can be determined by, for example, the processor 212 using the first vehicle data 304 and/or the second vehicle data 306. In other embodiments, the processor 212 can determine the TOA of the first vehicle 110*a* based on the first vehicle data 304 and receive the TOA of the second vehicle 110*b* from the second vehicle 110*b* using, for example, the network 204.

In one embodiment, at block 308 it is determined whether the TOA of the first vehicle 110*a* and the TOA of the second vehicle 110*b* are approximately the same, for example, within a predetermined threshold. As used herein, "approximately the same" is defined as when two or more values are approximately equal so that they are close enough in value so that the difference is inconsequential. For example, the processor 212 can compare the TOA of the first vehicle 110*a* and the TOA of the second vehicle 110*b* to determine whether the difference between the TOA of the first vehicle 110*a* and the TOA of the second vehicle 110*b* is less than and/or equal to a predetermined threshold (e.g., 0.5 second, one (1) second, two (2) seconds, three (3) seconds). Accordingly, the predetermined threshold is a difference or a range of differences between one or more values that makes the one or more values approximately equal.

The predetermined threshold can be stored by the remote server 202, the first vehicle 110*a* and/or the second vehicle 110*b*. In one embodiment, the processor 248 of the remote server 202 can calculate the predetermined threshold based on one or more factors about the first vehicle 110*a*, the second vehicle 110*b*, and/or the intersection 100, including, but not limited to, a velocity of the vehicles, a size of the vehicles, a type of the vehicles (e.g., truck, sedan, motorcycle, bus) traffic flow and/or density at the intersection 100, the type of intersection, the regulatory sign at the intersection 100, current weather conditions, road conditions, the speed limit of one or more of the first road 102, the second road 104, the third road 106, and the fourth road 108, and the geography of the first road 102, the second road 104, the third road 106, and the fourth road 108. In some embodiments, one or more factors about the drivers (not shown) of the first vehicle 110*a* and the second vehicle 110*b* can be used for calculating the predetermined threshold. For example, physiological characteristics, psychological characteristics, and/or social characteristics. In some embodiments, the one or more factors about the drivers can be accessed from driver profiles (not shown) stored at the first vehicle 110*a*, the second vehicle 110*b*, and/or the remote server 202. In other embodiments, the one or more factors can be determined from the sensors 210 and/or the sensors 234.

In some embodiments, the predetermined threshold can be fixed (e.g., three (3) seconds. In another embodiment, the predetermined threshold can be adjustable based on the factors described above with respect to the vehicles 110 and the drivers of the vehicles 110. As an illustrative example, the predetermined threshold can be set to a default value of three (3) seconds. The predetermined threshold can be changed for different vehicle types detected at the intersection 100. For example, if the first vehicle 110*a* is a sedan and the second vehicle 110*b* is a truck, the processor 248 can modify the predetermined threshold by increasing the predetermined threshold from three (3) seconds to five (5) seconds. In this example, the predetermined threshold is increased considering the truck requires a longer period of time to stop than the sedan. With respect to an adjustable predetermined threshold, it one embodiment, at block 308, the processor 248 applies the default predetermined threshold (e.g., three (3) seconds), and upon detecting a velocity of the first vehicle 110*a* and/or the second vehicle 110*b* meets a velocity threshold (e.g., 3 mph), the processor 248 adjusts the default predetermined threshold based on one or more of the factors discussed above.

In another illustrative embodiment, block 308 can include determining whether one or more of the plurality of vehicles 110 have a TOA at the intersection 100 that is approximately the same. For example, the processor 212 can determined whether the TOA of the first vehicle 110*a*, the TOA of the second vehicle 110*b*, the TOA of the third vehicle 110*c*, and/or the TOA of the fourth vehicle 110*d* are approximately the same, for example, within the predetermined threshold described above.

At block 310, the method 300 includes determining a driving behavior of the first vehicle 110*a* and a driving behavior of the second vehicle 110*b*. More specifically, at block 310 the method 300 includes receiving first vehicle behavior data 312 about the first vehicle 110*a* travelling along the first road segment (e.g., a segment or a portion of the first road 102) for a previous time of duration before the time of arrival of the first vehicle 110*a* at the intersection 100. The first vehicle behavior data 312 can include any driving parameter, vehicle system parameter, or other driving characteristic of the first vehicle 110*a* and/or the driver (not shown) of the first vehicle 110*a*. As an illustrative example, the first vehicle behavior data 312 can include an average speed of the first vehicle 110*a* for the previous time of duration before the time of arrival of the first vehicle 110*a* at the intersection 100. Similarly, at block 310 the method 300 includes receiving second vehicle behavior data 314 about the second vehicle 110*b* travelling along the second road segment (e.g., a segment or a portion of the second road 104) for a previous time of duration before the time of arrival of the second vehicle 110*b* at the intersection 100. It is understood that in another illustrative embodiment, block 310 can also include determining a driving behavior of the third vehicle 110*c* and the fourth vehicle 110*d*.

As mentioned above with block 302, the first vehicle behavior data 312 can be acquired from the vehicle systems 208 and/or the sensors 210. The second vehicle behavior data 314 can be acquired from the vehicle systems 232 and/or the sensors 234. In some embodiments, data about the first vehicle 110*a* and/or the second vehicle 110*b* can be acquired from other vehicles (e.g., the third vehicle 110*c*, the fourth vehicle 110*d*) at the intersection 100. In some embodiments, the first vehicle behavior data 312 and/or the second vehicle behavior data 314 can be received at block 310. In other embodiments, the first vehicle behavior data 312 and/or the second vehicle behavior data 314 can be accessed from driver profiles (not shown) stored at the first vehicle 110*a*, the second vehicle 110*b*, and/or the remote server 202.

In another embodiment, the first vehicle behavior data 312 and/or the second vehicle behavior data 314 can be acquired from the system itself. For example, the remote server 202 can store historical right of way data about the intersection 100, the first vehicle 110*a*, the second vehicle 110*b*, and the third vehicle 110*c*. The historical right of way data can include data and/or actions of previous right of way negotiations handled by the remote server 202. For example, a count of the number of times the first vehicle 110*a* gave another vehicle the right of way, the average waiting time of the first vehicle 110*a* and/or the second vehicle 110*b* at the intersection 100, among others.

The first vehicle behavior data 312 characterizes a behavior and/or style of driving of the first vehicle 110*a* and/or the driver (not shown) of the first vehicle 110*a*. For example, the first vehicle behavior data 312 can characterize a level of driving aggressiveness of the first vehicle 110*a*. Similarly, the second vehicle behavior data 314 can characterize a level of driving aggressiveness of the second vehicle 110*b*. A behavior and/or style of driving can include, but is not limited to, fast, slow, nervous, distracted, cautious, rational, precise, relaxed, tolerant, responsive, risky, aggressive, non-aggressive, assertive, passive, economical, and moderate, among others.

The term "level" as used throughout this detailed description and in the claims refers to any numerical or other kind of value for distinguishing between two or more states of driving behavior and/or style. For example, in some cases, the level can be given as a percentage between 0% and 100%, where 0% refers to a vehicle having passive driving style and 100% refers to a vehicle that has aggressive driving style. In other cases, the level could be a value in the range between 1 and 10. In still other cases, the level is not a numerical value, but could be associated with a given discrete state, such as "aggressive," "very aggressive," "cautious," "very cautious" and "extremely cautious." Moreover, the level of drowsiness could be a discrete value or a continuous value.

Referring again to block 310, the method 300 can also include analyzing vehicle data to determine and/or characterize the driving style and/or behavior of the first vehicle 110*a* and/or the second vehicle 110*b*. Similarly, it is understood that block 310 can also include analyzing vehicle data to determine and/or characterize the driving style and/or behavior of the first vehicle 110*a*, the second vehicle 110*b*, the third vehicle 110*c*, and the fourth vehicle 110*d*. The processor 212 may identify different patterns in the first vehicle behavior data 312 that indicate a particular driving style and/or behavior. As an illustrative example, steering wheel information can be received from the vehicle systems 208 and/or the sensors 210 (e.g., from an EPS system, steering angle sensor, steering torque sensors). By analyzing the steering wheel information, the processor 212 may identify patterns of steering behavior that indicate a particular driving style and/or behavior.

As another illustrative example, an average speed of the first vehicle 110*a* can be received and/or determined from the vehicle systems 208 and/or the sensors 210. The processor 212 may determine the driving behavior of the first vehicle 110*a* as aggressive if the average speed of the first vehicle 110*a* is greater than a predetermined threshold. As a further illustrative example, a number of accelerations and/or decelerations of the first vehicle 110*a* can be received and/or determined from the vehicle systems 208 and/or the sensors 210. The processor 212 may determine the driving behavior of the first vehicle 110*a* as aggressive if the number of accelerations and/or decelerations of the first vehicle 110*a* is greater than a predetermined threshold.

As a further illustrative example with respect to historical right of way data discussed above, a frequency of how many times the first vehicle 110*a* and/or the second vehicle 110*b* allowed another vehicle to have the right of way can be used to determine a level of aggressiveness. For example, if the first vehicle 110*a* has allowed another vehicle the right of way at the intersection 100 15 times, and the second vehicle 110*b* has allowed another vehicle the right of way at the intersection 100 5 times, the processor 212 can determine that the first vehicle 110*a* is less aggressive than the second vehicle 110*b*. As another example, if the first vehicle 110*a* has a higher wait time at the intersection 100 than the second vehicle 110*b*, the first vehicle 110*a* is determined to be less aggressive than the second vehicle 110*b*.

As mentioned above, the first vehicle behavior data 312 is data about the first vehicle 110*a* for a previous time of duration before the TOA of the first vehicle 110*a*. For example, as shown in FIG. 1, the first vehicle 110*a* is shown in a stopped state at a TOA of the first vehicle 110*a* (i.e., the first vehicle 110*a* has arrived) at the intersection 100. Also shown is the first vehicle 110*a*' traveling along the first road 102 for a previous time of duration before the TOA of the first vehicle 110*a* at the first stop sign 112*a* and/or the first stop line 114*a*. Here, the previous time of duration is an interval of time before the TOA of the first vehicle 110*a*. The previous time of duration can be a temporal value (e.g., five (5) seconds). As an illustrative example, if the TOA of the first vehicle 110*a* is $t_{a1}$=14:53:00 (i.e., 2:53:00 pm) and the previous time of duration is d=00:00:10 (i.e., ten (10) seconds), the behavior data about the first vehicle 110*a* is captured between $t_d$=14:52:50 (i.e., $t_{a1}$=14:53:00-d=00:00:10 seconds) and $t_{a1}$=14:53:00. In other embodiments, a distance measurement can be used (e.g., one (1) meter) for the previous time of duration. As an illustrative example, the previous time of duration can be a point in time where the position of the first vehicle 110*a* is one (1) meter from a position of the first vehicle 110*a* at its TOA in a reverse direction. Accordingly, if the TOA of the first vehicle 110*a* is $t_{a1}$=14:53:00 (i.e., 2:53:00 pm) and the first vehicle 110*a* was positioned one (1) meter from the position of the first vehicle 110*a* at its TOA at $t_d$=14:23:00, the behavior data about the first vehicle 110*a* is captured between $t_d$=14:23:00 and $t_{a1}$=14:53:00.

Similarly, in FIG. 1, the second vehicle 110*b* is shown in a stopped state at a TOA of the second vehicle 110*b* (i.e., the second vehicle 110*b* has arrived) at the intersection 100. Also shown is the second vehicle 110*b*' traveling along the second road 104 for a previous time of duration before the TOA of the second vehicle 110*b* at the second stop sign 112*b* and/or the second stop line 114*b*. In some embodiments, the previous time of duration of the first vehicle 110*a* and the previous time of duration of the second vehicle 110*b* can be the same.

Referring again to FIG. 3, at block 316, the method 300 can include comparing the driving behavior and/or style of the vehicles. For example, the driving behavior (e.g., the first vehicle behavior data 312) of the first vehicle 110*a* is compared to the driving behavior (e.g., the second vehicle behavior data 314) of the second vehicle 110*b*. As an illustrative example, an average speed of the first vehicle 110*a* for five (5) seconds before the TOA of the first vehicle 110*a* and an average speed of the second vehicle 110*b* for five (5) seconds before the TOA of the second vehicle 110*b* can be compared at block 316. This comparison can be used to determine which vehicle has the right of way at the intersection 100. Additionally, it is understood that the driving behavior of the first vehicle 110*a* can be compared to the driving behavior of the second vehicle 110*b*, the driving behavior of the third vehicle 110*c*, and/or the driving behavior of the fourth vehicle 110*d*. As will be discussed herein, in this example, the driving behavior of each of the vehicles 110 can be ranked based on the comparison (e.g., most aggressive to least aggressive).

Accordingly, at block 318, the method 300 includes determining which vehicle has the right of way at the intersection 100. In one embodiment, the processor 212 determines which vehicle has the right of way based on rules stored at the first vehicle 110*a* and/or the remote server 202. For example, in one embodiment, the right of way is determined and/or assigned to the vehicle having a more aggressive driving behavior and/or style. Upon determining the driving behavior of the first vehicle 110*a* is less aggressive than the driving behavior of the second vehicle 110*b*, the processor 212 can determine that the second vehicle 110*b* has the right of way at the intersection 100. In another embodiment, the processor 212 identifies the first vehicle 110*a* or the second vehicle 110*b* as a yielding vehicle characterized by conservative driving behavior based on comparing the first vehicle behavior data 312 with the second vehicle behavior data 314. The yielding vehicle is the vehicle which allows the other vehicle the right of way. Thus, in this example, the processor 212 determines the vehicle having a more conservative driving behavior should yield to the vehicle having a less conservative driving behavior.

In another embodiment, which includes the first vehicle 110*a*, the second vehicle 110*b*, the third vehicle 110*c*, and the fourth vehicle 110*d*, determining which vehicle has the right of way is based on a level of aggressiveness. Based on the comparison determined at block 316, at block 318 each of the vehicles 110 can be ranked to determine which vehicle has the right of way. For example, the first vehicle 110*a*, the second vehicle 110*b*, the third vehicle 110*c*, and the fourth vehicle 110*d* can each be ranked (e.g., 1 to 4) based on a level of aggressiveness. For example, rank 1 would be assigned to the vehicle with the highest level of aggressiveness and rank 4 would be assigned to the vehicle with the lowest level of aggressiveness.

Referring again to the method 300, block 320 includes transmitting a resolution message to the first vehicle 110*a* and/or the second vehicle 110*b* based on comparing the behavior data about the first vehicle 110*a* and the behavior data about the second vehicle 110*b*. The resolution message includes information for determining a right of way maneuver at the intersection 100, for example, between the first vehicle 110*a* and the second vehicle 110*b* at the intersection 100. A right of way maneuver as described herein in a vehicle maneuver proceeding through the intersection 100 and/or turning onto an adjacent road of the intersection 100. For example, if the right of way is given to the first vehicle 110*a*, a right of way maneuver executed by the first vehicle 110*a* may include the first vehicle 110*a* proceeding through the intersection 100 to the third road 106, the first vehicle 110*a* turning left onto the fourth road 108, or the first vehicle 110*a* turning right onto the second road 104.

Referring again to block 320, as an illustrative example, upon determining the driving behavior of the first vehicle 110*a* is less aggressive than the driving behavior of the second vehicle 110*b*, the resolution message is transmitted to the first vehicle 110*a*. In this illustrative example, the resolution message suggests the second vehicle 110*b* execute the right of way maneuver. However, it is understood that in other embodiments, the resolution message may suggest the first vehicle 110*a* execute the right of way maneuver. As another illustrative example, the resolution message is transmitted to the vehicle that arrived slightly before the other vehicles based on the TOA determinations at block 308.

In one embodiment, the resolution message is displayed in the first vehicle 110*a* at a display (see FIGS. 5 and 6) and/or to the driver (not shown) of the first vehicle 110*a*. The first vehicle 110*a* and/or the driver can confirm and communicate the right of way instructions provided by the resolution message. Right of way communication will be described in more detail with respect to FIG. 4.

In another embodiment, transmitting the resolution message at block 320 can include transmitting a plurality of resolution messages based on the right of way determination at block 318. With respect to the illustrative example where the first vehicle 110*a*, the second vehicle 110*b*, the third vehicle 110*c*, and the fourth vehicle 110*d* can each be ranked, resolution messages can be transmitted based on the ranking. For example, a first resolution message can be transmitted to the vehicle with a rank of 4 (e.g., least aggressive), a second resolution message can be transmitted to the vehicle with a rank of 3, and so on.

Figure 4:
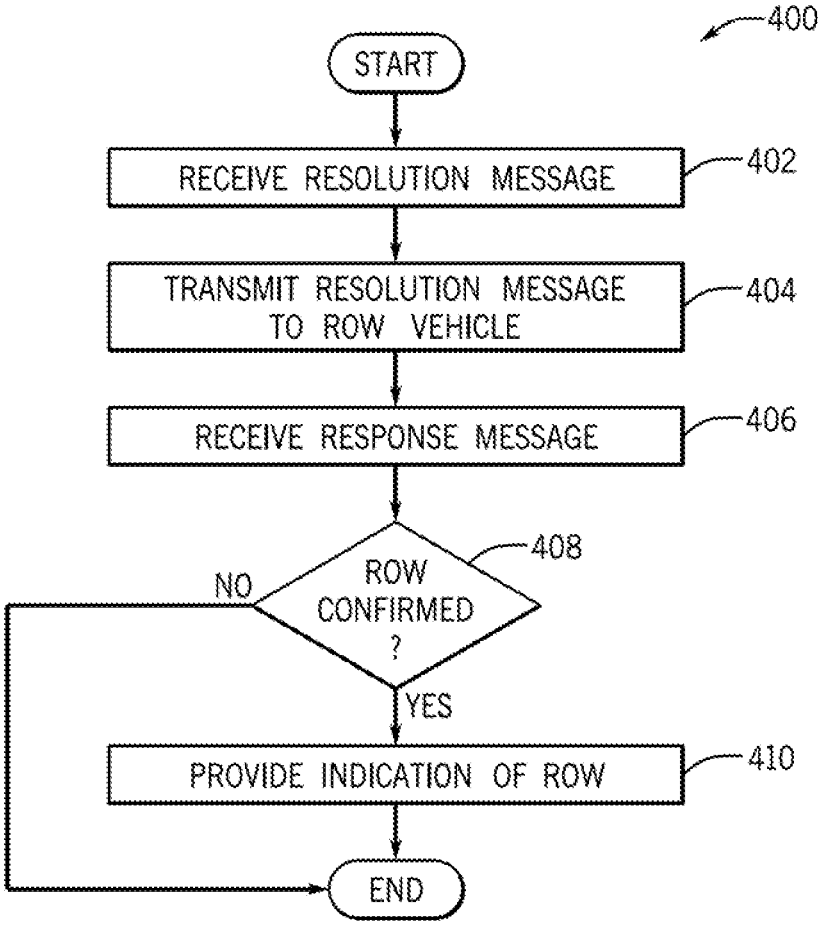
FIG. 4 is a process flow diagram of a method for resolving ambiguous right of way according to another exemplary embodiment.

Referring now to FIG. 4, a method 400 describes operations of one or more components of FIGS. 1 and 2 for resolving ambiguous right of way scenarios, and more specifically, for communication between one or more of the plurality of vehicles 110 (e.g., the first vehicle 110*a* and the second vehicle 110*b*) at the intersection 100. Although FIG. 4 is described with respect to the first vehicle 110*a* and the second vehicle 110*b*, it is understood that the methods and systems can be applied to any number of vehicles including the third vehicle 110*c* and the fourth vehicle 110*d*. At block 402, the method 400 includes receiving the resolution message. For example, as discussed with block 320 of the method 300, the first vehicle 110*a* receives the resolution message suggesting to allow the second vehicle 110*b* the right of way (e.g., allow the second vehicle 110*b* to execute a right of way maneuver through the intersection 100). As an illustrative example, the processor 212 can cause the display of the resolution message a display (not shown) of the first vehicle 110*a* stating "Give the second vehicle 110*b* the right of way."

Figure 5:
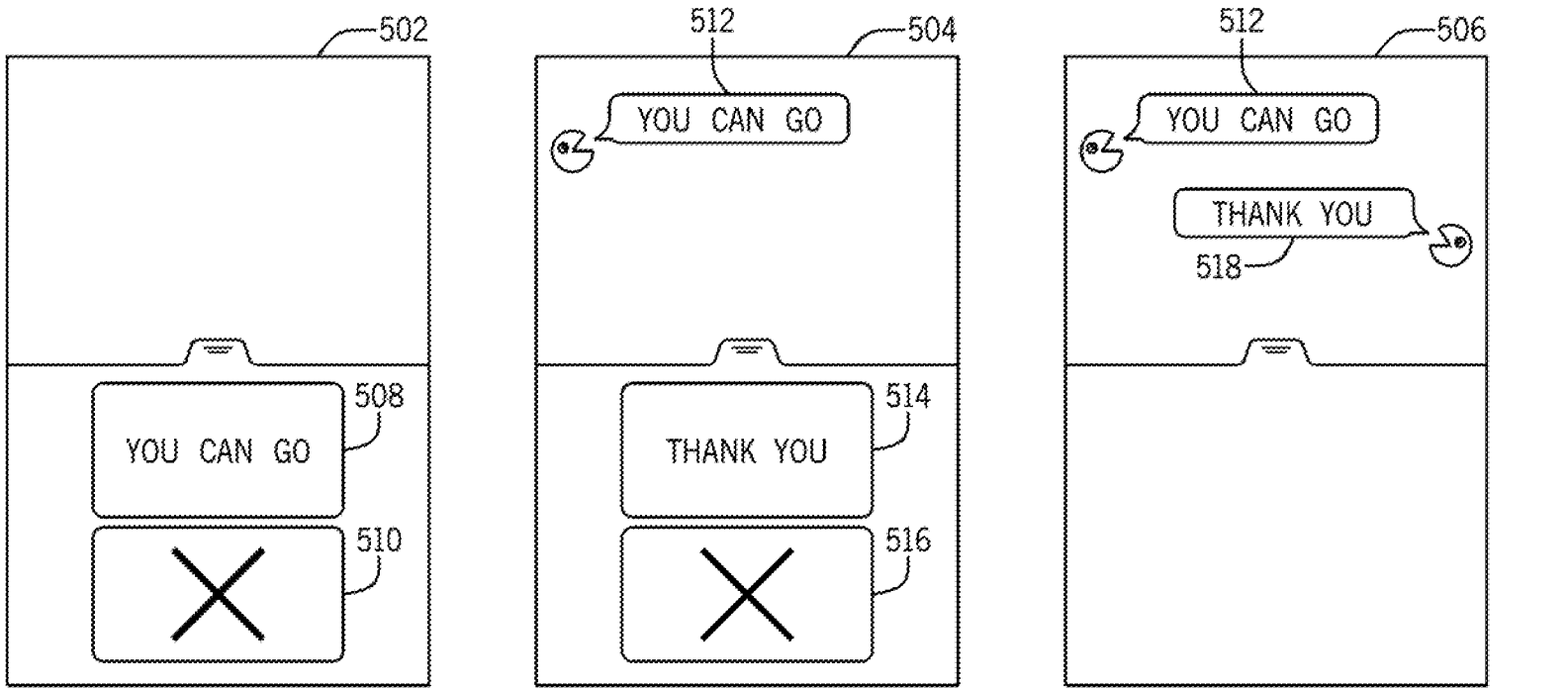
FIG. 5 shows illustrative user interfaces used during right of way communication according to an exemplary embodiment.

In some embodiments, the resolution message is a courtesy message for the first vehicle 110*a* to send to the second vehicle 110*b* stating, "You may go first." As an illustrative example with reference to FIG. 5, a series of exemplary user interfaces are shown illustrating communication between the first vehicle 110*a* and the second vehicle 110*b*. The user interfaces can be displayed on a display (not shown) of the vehicle 110*a* and/or the second vehicle 110*b*, or displayed on a portable device (not shown) associated with the first vehicle 110*a* and/or the second vehicle 110*b*. A user interface 502 illustrates a resolution message 508 and a rejection message 510 displayed to the first vehicle 110*a*. In this example, the resolution message 508 is a courtesy message for the first vehicle 110*a* to send to the second vehicle 110*b* to notify the second vehicle 110*b* that it can have the right of way. The rejection message 510 allows the first vehicle 110*a* the option to not give the right of way to the second vehicle 110*b*.

At block 404, the method 400 includes transmitting the resolution message to a right of way (ROW) vehicle. Thus, the first vehicle 110*a* using, for example, the network 204, transmits the resolution message to the second vehicle 110*b* (e.g., the ROW vehicle). In one embodiment, the driver (not shown) of the first vehicle 110*a* provides input (e.g., via the display) to execute the transmission of the resolution message to the second vehicle 110*b*. Referring again to the illustrative example, the processor 212 using the communication I/F 220 and the network 204 transmits the resolution message "you may go first" to the second vehicle 110*b*. This allows the driver of the first vehicle 110*a* to confirm the suggestion that the second vehicle 110*b* have the right of way at the intersection 100 by transmitting the resolution message to the second vehicle 110*b*. Referring again to the illustrative example of FIG. 5, the resolution message 508 is selected thereby transmitting the resolution message to the ROW vehicle. A user interface 504 of the second vehicle 110*b* illustrates receipt of the resolution message 508 displayed as resolution message 512.

In some embodiments, the first vehicle 110*a* may not want to give the right of way to the second vehicle 110*b*. For example, in one embodiment, the driver (not shown) of the first vehicle 110*a* provides input (e.g., via the display) rejecting the suggestion that the second vehicle 110*b* have the right of way at the intersection 100. The input could indicate the driver of the first vehicle 110*a* wants the right of way at the intersection 100 (e.g., "I want to go first") 100 and/or the input could simply ignore the suggestion so that the first vehicle 110*a* does not initiate the communication. Referring again to FIG. 5, the rejection message 510 allows the first vehicle 110*a* the option to not give the right of way to the second vehicle 110*b*.

In another embodiment, credits and/or incentives can be provided and/or exchanged between the first vehicle 110*a* and the second vehicle 110*b* based on the responses to the resolution message and/or a response message. For example, if the first vehicle 110*a* does not way to give the right of way to the second vehicle 110*b*, and the second vehicle 110*b* allows the first vehicle 110*a* to have the right of way instead, the processor 248 can determine and allocate a credit and/or incentive to the second vehicle 110*b*. This provides a way to encourage collaboration and cooperation at the intersection 100. Other scenarios can also be contemplated for providing incentives to the vehicles 110 to cooperate at the intersection 100. The credit and/or incentive can based in any type of currency or reward, for example, monetary currency (e.g., dollar, euro), bitcoin, crypto currency, stocks, bonds, discounts, non-monetary goods, among others.

At block 406, the method 400 includes receiving a response message from the ROW vehicle in response to transmission of the resolution message. Thus, the first vehicle 110*a* can receive a response message from the second vehicle 110*b*. In one embodiment, the response message includes a confirmation of the right of way maneuver (e.g., "Thank You). Accordingly, at block 408, it is determined if the ROW vehicle has confirmed the right of way maneuver. Said differently, it is determined whether the second vehicle 110*b* has accepted the right of way offer from the first vehicle 110*a*.

Referring again to the illustrative example shown in FIG. 5, the user interface 504 provides the second vehicle 110*a* with a response message 514 and a rejection message 516. By selecting the response message 514, the second vehicle 110*a* confirms the right of way maneuver and communicates same to the first vehicle 110*a* as shown in the user interface 506 and a response message 518.

In some embodiments, the second vehicle 110*b* can reject the right of way offer from the first vehicle 110*a*. For example, in one embodiment, the driver (not shown) of the second vehicle 110*b* provides input (e.g., via the display) rejecting the offer that the second vehicle 110*b* have the right of way at the intersection 100. For example, input could include the message "No, Thank you. You may go." Referring again to the illustrative example shown in FIG. 5, the user interface 504 provides the second vehicle 110*a* with the rejection message 516. By selecting the rejection message 516, the second vehicle 110*a* rejects the right of way maneuver and communicates (not shown) same to the first vehicle 110*a*.

If the determination at block 408 is YES, at block 410 the method 400 includes providing an indication of the ROW maneuver. In one embodiment, the processor 212 controls the first vehicle 110*a* to provide an indication of allowing the second vehicle 110*b* to proceed with the right of way maneuver. For example, the first vehicle 110*a* can provide a visual and/or an audible indication to other vehicles in proximity to the intersection 100 that the second vehicle 110*b* has the right of way. In another embodiment, the second vehicle 110*b* can provide a visual and/or an audible indication to other vehicles in proximity to the intersection 100 before and during the right of way maneuver.

Figure 6:
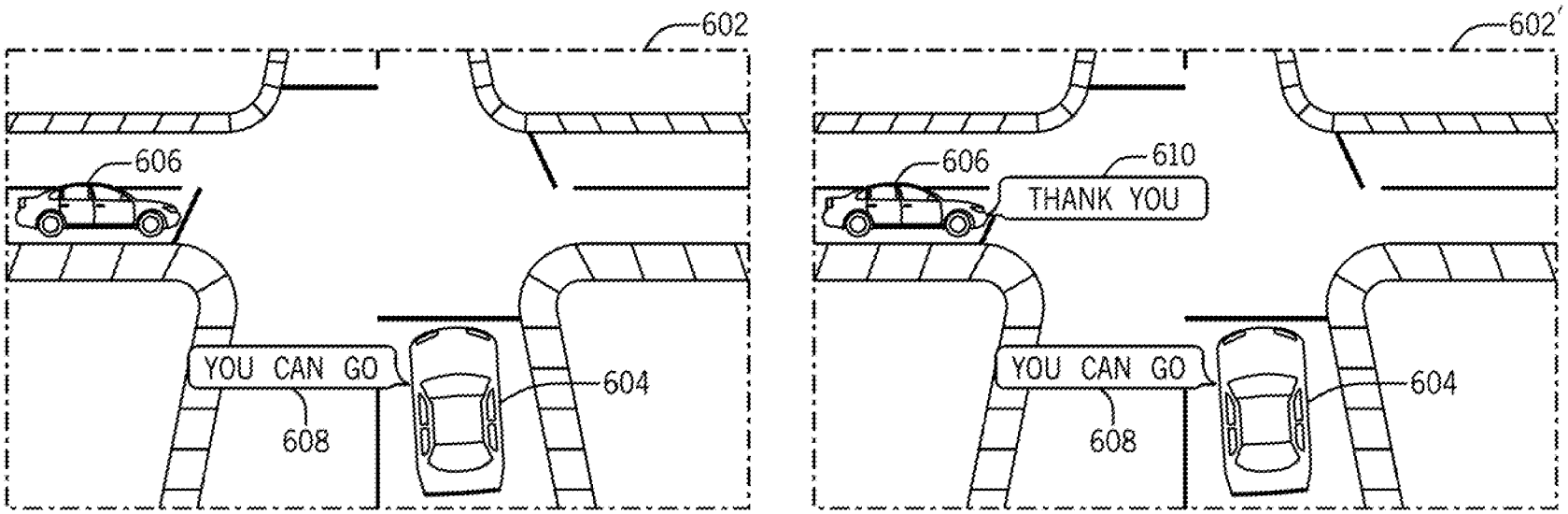
FIG. 6 shows illustrative heads-up-display interfaces used during right of way communication according to an exemplary embodiment.

In a further embodiment, the first vehicle 110*a* and the second vehicle 110*b* are equipped with a heads-up-display (HUD) in addition to or in lieu of an input/output device. The heads-up-display can be used for the driver to provide input and to display communication with another vehicle. Referring now to FIG. 6, a HUD display 602 and a HUD display 602' are shown illustrating right of way communication. The HUD display 602 and the HUD display 602' show a visual representation of a first vehicle 604 and a second vehicle 606. The HUD display 602 illustrates a resolution message 608 from the first vehicle 604 to the second vehicle 606 allowing the second vehicle 606 to have the right of way. The HUD display 602' shows a response message 610 indicating that the second vehicle 606 has accepted the right of way from the first vehicle 604. This communication process allows drivers to respond more naturally to ambiguous right of way situations. The drivers can feel more comfortable to yield and/or proceed through an intersection based on the drivers' driving behavior, which in turn creates more efficient intersections.

It is understood that in some embodiments, one or more vehicles 110 at the intersection 100 may not be configured and/or capable of V2V communication (e.g., over the network 204). As an illustrative example, the first vehicle 110*a* can use data from the sensors 210 (e.g., camera sensors) to detect surrounding non-V2V vehicles, and further calculate the direction of the non-V2V vehicles relative to the first vehicle 110*a* using data from the sensors 210 (e.g., camera sensors, RADAR). Additionally, the first vehicle 110*a* can receive position data from V2V-enabled vehicles. Thus, the first vehicle 110*a* can calculate the position of the V2V-enabled vehicles and the non-V2V vehicles. A display (not shown) can show a graphic representation of the first vehicle 110*a* and all the surrounding vehicles based on the calculated positions. This allows the first vehicle 110*a* to easily understand who the first vehicle 110*a* is communicating with. Further, in this scenario, to communicate the resolution message to a non-V2V vehicle, a display message projected to the non-V2V vehicle and/or an area surrounding the non-V2V vehicle can be utilized to convey the resolution message. In some embodiments, a LED board on a windshield of the first vehicle 110*a* can be used to display the resolution message to the non-V2V vehicle.

The embodiments discussed herein can also be described and implemented in the context of "computer-readable medium" or "computer storage medium." As used herein, "computer-readable medium" or "computer storage medium refers to a non-transitory medium that stores instructions, algorithms, and/or data configured to perform one or more of the disclosed functions when executed. Computer-readable medium can be non-volatile, volatile, removable, and non-removable, media implemented in any method or technology for storage of information such as computer readable instructions, data structures, modules or other data. Computer-readable medium can include, but is not limited to, a floppy disk, a flexible disk, a hard disk, a magnetic tape, other magnetic medium, an application specific integrated circuit (ASIC), a programmable logic device, a compact disk (CD), other optical medium, a random access memory (RAM), a read only memory (ROM), a memory chip or card, a memory stick, solid state storage device (SSD), flash drive, and other media from which a computer, a processor or other electronic device can interface with. Computer-readable medium excludes non-transitory tangible media and propagated data signals.

It will be appreciated that various embodiments of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A computer-implemented method for communication between a plurality of vehicles at an intersection, comprising:

detecting the intersection ahead of a first vehicle, wherein the first vehicle is travelling along a first road segment that leads to the intersection and a second vehicle is travelling along a second road segment that leads to the intersection;

determining a time of arrival of the first vehicle at the intersection and a time of arrival of the second vehicle at the intersection is approximately the same;

receiving behavior data about the first vehicle travelling along the first road segment for a previous time of duration before the time of arrival of the first vehicle at the intersection;

receiving behavior data about the second vehicle travelling along the first road segment for a previous time of duration before the time of arrival of the second vehicle at the intersection; and transmitting a resolution message to the first vehicle or the second vehicle based on comparing the behavior data about the first vehicle and the behavior data about the second vehicle, wherein the resolution message includes information for determining a right of way maneuver between the first vehicle and the second vehicle at the intersection.

2. The computer-implemented method of claim 1, including receiving vehicle data from the first vehicle and vehicle data from the second vehicle, wherein determining the time of arrival of the first vehicle at the intersection and the time of arrival of the second vehicle at the intersection is approximately the same is based on the vehicle data from the first vehicle and the vehicle data from the second vehicle.

3. The computer-implemented method of claim 1, wherein determining the time of arrival of the first vehicle at the intersection and the time of arrival of the second vehicle at the intersection is approximately the same is based on determining a difference between the time of arrival of the first vehicle and the time of arrival of the second vehicle and comparing the different to a predetermined threshold.

4. The computer-implemented method of claim 1, wherein the behavior data about the first vehicle travelling along the first road segment characterizes a level of driving aggressiveness of the first vehicle.

5. The computer-implemented method of claim 4, wherein the behavior data about the second vehicle travelling along the first road segment characterizes a level of driving aggressiveness of the second vehicle.

6. The computer-implemented method of claim 5, including upon determining a driving behavior of the first vehicle is less aggressive than a driving behavior of the second vehicle, transmitting the resolution message to the first vehicle, wherein the resolution message suggests the second vehicle execute the right of way maneuver first.

7. The computer-implemented method of claim 6, wherein the first vehicle transmits the resolution message to the second vehicle, and the first vehicle receives a response message from the second vehicle, wherein the response message includes a confirmation of the right of way maneuver.

8. The computer-implemented method of claim 7, including controlling the first vehicle to provide an indication of allowing the second vehicle to proceed with the right of way maneuver.

9. A system for communication between a plurality of vehicles at an intersection, comprising:

a sensor system for detecting a first vehicle and a second vehicle approaching the intersection, wherein the first vehicle is travelling along a first road segment that leads to the intersection and the second vehicle is travelling along a second road segment that leads to the intersection; and a processor operatively connected for computer communication with the sensor system using a network, wherein the processor:

determines a time of arrival of the first vehicle at the intersection and a time of arrival of the second vehicle at the intersection is approximately the same;

receives behavior data from the sensor system about the first vehicle travelling along the first road segment for a previous time of duration before the time of arrival of the first vehicle at the intersection;

receives behavior data from the sensor system about the second vehicle travelling along the second road segment for a previous time of duration before the time of arrival of the second vehicle at the intersection; and transmits a resolution message to the first vehicle or the second vehicle based on comparing the behavior data about the first vehicle and the behavior data about the second vehicle, wherein the resolution message includes information for determining a right of way maneuver between the first vehicle and the second vehicle at the intersection.

10. The system of claim 9, wherein the behavior data about the first vehicle travelling along the first road segment characterizes a level of driving aggressiveness of the first vehicle.

11. The system of claim 10, wherein the behavior data about the second vehicle travelling along the second road segment characterizes a level of driving aggressiveness of the second vehicle.

12. The system of claim 11, wherein the processor identifies the first vehicle or the second vehicle as a yielding vehicle characterized by conservative driving behavior based on the behavior data about the first vehicle and the behavior data about the second vehicle.

13. The system of claim 12, wherein the processor transmits the resolution message to the yielding vehicle, wherein the resolution message includes instructions to give the second vehicle the right of way at the intersection.

14. A non-transitory computer-readable storage medium including instructions that when executed by a processor, cause the processor to:

detect a first vehicle and a second vehicle travelling towards an intersection;

determine a time of arrival of the first vehicle at the intersection and a time of arrival of the second vehicle at the intersection is approximately the same;

receive behavior data about the first vehicle for a previous time of duration before the time of arrival of the first vehicle at the intersection;

receive behavior data about the second vehicle for a previous time of duration before the time of arrival of the second vehicle at the intersection; and transmit a resolution message to a vehicle selected from the first vehicle and the second vehicle including instructions for determining a right of way maneuver between the first vehicle and the second vehicle at the intersection based on comparing the behavior data about the first vehicle and the behavior data about the second vehicle.

15. The non-transitory computer-readable storage medium of claim 14, wherein the behavior data about the first vehicle characterizes a driving behavior of the first vehicle for the previous time of duration before the time of arrival of the first vehicle at the intersection.

16. The non-transitory computer-readable storage medium of claim 15, wherein the behavior data about the second vehicle characterizes a driving behavior of the second vehicle for the previous time of duration before the time of arrival of the second vehicle at the intersection.

17. The non-transitory computer-readable storage medium of claim 16, including causing the processor to transmit the resolution message including instructions allowing the right of way maneuver to the vehicle selected from the first vehicle and the second vehicle having a more aggressive driving behavior based on comparing the driving behavior of the first vehicle for the previous time of duration before the time of arrival of the first vehicle at the intersection and the driving behavior of the second vehicle for the previous time of duration before the time of arrival of the second vehicle at the intersection.

18. The non-transitory computer-readable storage medium of claim 17, including causing the processor to transmit the resolution message to the vehicle selected from the first vehicle and the second vehicle having a more conservative driving behavior based on comparing the driving behavior of the first vehicle for the previous time of duration before the time of arrival of the first vehicle at the intersection and the driving behavior of the second vehicle for the previous time of duration before the time of arrival of the second vehicle at the intersection.

19. The non-transitory computer-readable storage medium of claim 14, wherein the behavior data about the first vehicle characterizes a level of driving aggressiveness of the first vehicle, and the behavior data about the second vehicle characterizes a level of driving aggressiveness of the second vehicle.

* * * * *